343-909 SR
3/28/78 XR 4,081,803

United States Patent [19]
Dempsey

[11] 4,081,803
[45] Mar. 28, 1978

[54] MULTIOCTAVE TURNSTILE ANTENNA FOR DIRECTION FINDING AND POLARIZATION DETERMINATION

[75] Inventor: Richard C. Dempsey, Chatsworth, Calif.

[73] Assignee: International Telephone and Telegraph Corporation, New York, N.Y.

[21] Appl. No.: 633,623

[22] Filed: Nov. 20, 1975

[51] Int. Cl.² ..... H01Q 21/26; H01Q 21/28
[52] U.S. Cl. ..... 343/795; 343/798; 343/816; 343/909
[58] Field of Search ..... 343/787, 795, 798, 816, 343/909

[56] References Cited

U.S. PATENT DOCUMENTS

| | | | |
|---|---|---|---|
| 3,681,771 | 8/1972 | Lewis et al. | 343/817 |
| 3,701,158 | 10/1972 | Johnson | 343/770 |

*Primary Examiner*—Eli Lieberman
*Attorney, Agent, or Firm*—William T. O'Neil

[57] ABSTRACT

A multioctave, multifunction antenna system including three planar terraces each having four symetrically placed individual turnstile arrays. A first terrace includes turnstile arrays of a first relatively large size, the second terrace is axially spaced therefrom and includes four second individual turnstile arrays of a second size smaller than the first size. A third terrace includes a similar arrangement of four individual turnstile arrays of a third and smallest size. A ground plane for the arrays of the second and third terraces is included in the plane of the next larger arrays, the first terrace having a spaced ground plane in a separate plane. Between the planes of each terrace an absorbing material provides a lossy medium for broadbanding and reduction of the interaction among the arrays of any given terrace with those of the other terraces. The elements or lobes of each dipole of each turnstile is arranged for separate feed, permitting maximum flexibility in respect to the overall mode of operation, i.e., such as for polarization determination, monopulse, etc.

12 Claims, 5 Drawing Figures

FIG. 2
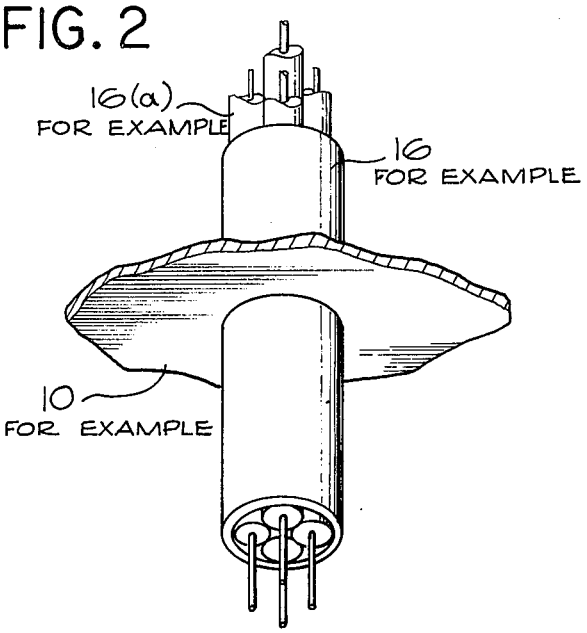
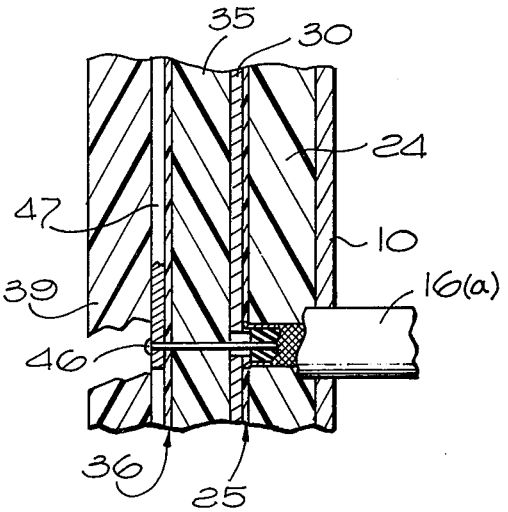
FIG. 3
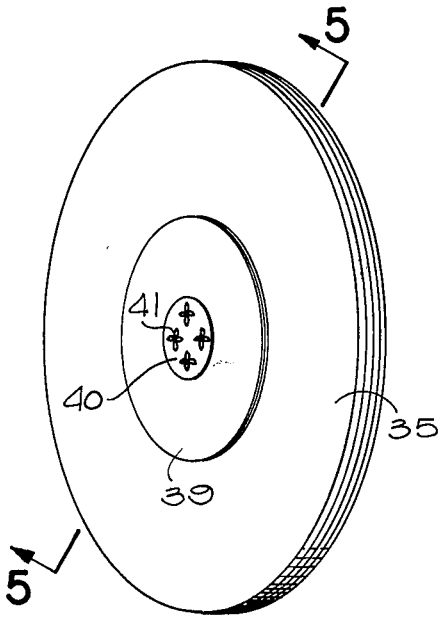
FIG. 4
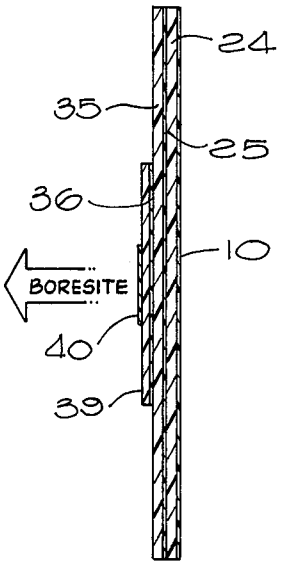
FIG. 5

MULTIOCTAVE TURNSTILE ANTENNA FOR DIRECTION FINDING AND POLARIZATION DETERMINATION

BACKGROUND OF THE INVENTION

1. Field of the Invention

The invention relates generally to electromagnetic antenna systems, and more particularly, to wideband antenna systems including plural individual arrays employable for such purposes as direction finding, polarization determination, etc.

2. Description of the Prior Art

In the prior art, antenna systems for the general problem of signal surveillance and analysis have taken a number of forms. In general, where there usually is a requirement for signal surveillance over a large band of frequencies. Systems involving log-spiral antennas and the like, have been known and used. Those particular prior art devices, and other known prior art devices for the purposes, have presented disadvantages, particularly in size and flexibility. The spirals, for examples, must be on the order of a full wavelength in diameter to provide satisfactory operation in more than a single mode. A mode for the purpose of this specification is, for example, a direction finding mode, a polarization determining mode, etc.

In many applications, such as in connection with airborne or spaceborne platforms, the size of the antenna structure and its weight are critical considerations, especially if operation in lower frequency bands is required.

In addition, many prior art multiband, multimode antenna arrangements do not have the ability to discriminate against electromagnetic energy arriving at angles widely separated from the antenna boresite. This is particularly true of antennas of the spiral type, since the antenna aperture size is larger for the secondary than the primary mode of radiation, and therefore the higher modes lie within the beamwidth of the primary mode.

Still further, the spiral antenna structure and other prior art structures preclude, in general, the ability to make clear determination of polarization characteristics of arriving signals to be analyzed.

The manner in which the present invention solves the problems of the prior art in an unique combination providing wideband multimode operation in a relatively small and lightweight assembly, will be understood as this description proceeds.

SUMMARY OF THE INVENTION

In accordance with the disadvantages of the prior art, it may be said to have been the general objective to provide a novel, multioctave, multifunction antenna which is particularly suited for electromagnetic surveillance purposes and is adapted for feed network arrangements consistent with response modes required for direction finding, homing and polarization determination purposes.

The antenna combination according to the present invention is a multioctave multifunction turnstile array in multiple, dielectrically-loaded and terraced form.

The particularly unique features are wide bandwidth, small size, constant phase center, and the aforementioned capabilities for direction finding and homing response, particularly by means of monopulse techniques; and also the capability for polarization determination.

In its most basic form, a device according to the present invention, involves an unique arrangement of dipole elements arranged such that each lobe or leg of the dipole is separately fed near the dipole center. Although the so-called "bow-tie" configuration might be used, the most desirable element configuration is that of the so-called turnstile antenna. That configuration comprises two orthogonally oriented dipoles (four lobes).

A plurality of these turnstile antennas is symetrically arranged in a plane or terrace and there are a plurality of terraces, scaled from relatively large to relatively small, in a concentric buildup (large to small) in the direction of boresite of the antenna assembly. These terraces are spaced from each other along the line of boresite and each terrace comprises the symmetrical plurality of turnstile antennas and is backed by a ground plane, preferably in the central area of the next larger turnstile terrace. The final (lowest frequency or largest terrace of turnstiles) cooperates with a ground plane at least as large as a congruent surface would be, that ground plane being also spaced from the first (largest) corresponding cooperating terrace of turnstile antennas.

Loading is provided by means of a lossy material between terraces and corresponding ground plates, and also shrouding the turnstile terrace assemblies in the incident wave directions.

The complete device is a highly novel combination of turnstile antennas with ground planes, step terracing and loading by means of the aforementioned lossy material. Both the lossy material and the step terracing contribute to the effective isolation (elimination of interaction) among the turnstiles of various terraces. Moreover, the lossy material tends to increase bandwidth and sensitivity to vertically polarized components for angles other than normal to the surface. The entire assembly is essentially omnidirectional, i.e., capable of receiving signals throughout the hemisphere of space symetrically disposed about the line of boresite.

The independent feed of each lobe or leg of each dipole in each turnstile of each of the terraces provides maximum flexibility in applying beam forming networks for the instrumentation of monopulse direction finding, homing, and polarization determination modes of operation. The turnstiles are essentially nonresonant devices and each of the various terraces is relatively broadband in its response, to form a contiguous series of frequency bands, such that the overall bandwidth may be exceptionally wide for a structure of very small size and weight indeed, as compared to its overall bandwidth and lowest frequency response.

The detailed manner in which the typical embodiment employing the principles of the present invention may be constructed is illustrated in the drawings herewith and these are described hereinafter.

BRIEF DESCRIPTION OF THE DRAWINGS

FIG. 2 illustrates the coaxial feed configuration applicable to each turnstile antenna of the device.

FIG. 3 is a sectional view taken through the central feed area of any of the turnstile antennas illustrating the feed details.

FIG. 4 is an isometric view of an assembled antenna according to the invention.

FIG. 5 is a sectional view taken through FIG. 4 as indicated.

DESCRIPTION OF THE PREFERRED EMBODIMENT

Figure 1:
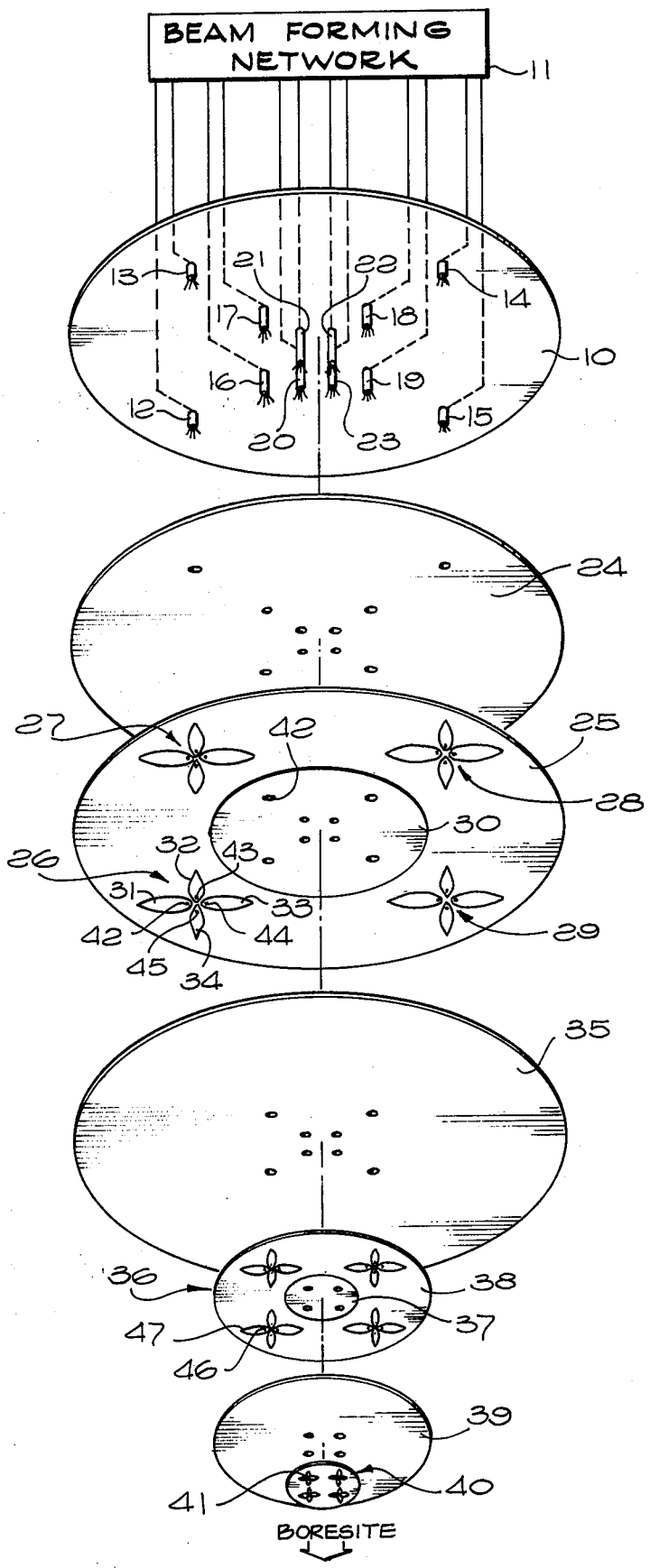
FIG. 1 is an exploded view of a three terrace version of an antenna assembly according to the present invention.

Referring now to FIG. 1, an exploded pictorial view is presented, it being understood that the fully assembled device presents an appearance much like FIG. 4 and fits together as illustrated in the sectional view of FIG. 5.

In FIG. 1, the basic conductive plane 10, provides a ground plane for 25, the first terrace of turnstile elements. This sub-assembly 25 comprises a dielectric sheet which is substantially transparent to radio frequency waves and plays essentially no part in the electrical functioning of the device. Rather, this dielectric carrier disc simply provides a mechanical support medium upon which the four turnstile antenna subsystems 26, 27, 28 and 29 are supported. For purposes of this description, each of these turnstile sub-assemblies or subsystems, for example 26, comprises two dipoles physically oriented orthogonally with respect to each other. Thus, the lobes 31 and 33 comprise one dipole and the corresponding orthogonally related dipole comprises lobes 32 and 34. In the center area an independent feed point for each of these lobes is shown. For example, the feedpoint 42 corresponds to lobe 31, and the feedpoint 44 corresponds to lobe 33. In the orthogonal dipole comprising lobes 32 and 34, feedpoints 43 and 45, respectively, apply. Thus, each of the four lobes of each of the turnstile subsystems is independently fed, the details of this feed being described more in detail as this description proceeds.

It may be said that the entire assembly comprises a plurality of concentric arrays of turnstile elements with each array of elements terraced above the other in ascending order of frequency extending from a reference conductive mounting surface 10. In the embodiment described, three terraces are shown, the lowest frequency (largest turnstile elements) terrace is 25, the intermediate terrace being 36 and the highest frequency being 40. Within these intermediate and high frequency terraces, typical scaled-down turnstile subsystems 38 and 41, respectively, are similarly each carried by a thin dielectric disc as depicted.

Sandwiched between ground plane and individual terraces are the absorbent material discs 24, 35 and 39.

The ground planes 30 and 37 are preferably in the same plane as the turnstiles of terraces 25 and 36, respectively. These ground planes are relatively thin, conductive layers upon which the turnstile elements may be very satisfactorily applied by printed circuit techniques.

Returning now to the main ground plane surface 10, a number of multiple, coaxial, feed line groups are shown projecting through the plane. Of these, 12, 13, 14 and 15, the relatively short ones, pass through the absorbent material 24, and provide four coaxial center conductor feed connections to a particular turnstile antenna subsystem. In the case of the feed group 12, connection is made to lobes 31, 32, 33 and 34, at feed points 42, 43, 44 and 45, respectively, from the aforementioned individual center conductors of the feed group 12. Similarly, the turnstile 27 is fed from the feeds 13, and turnstiles 28, 29 are connected to the corresponding feed groups 14 and 15, respectively.

In the same way, the feeds 16, 17, 18 and 19 have their outer shields connected to ground plane 30, the center conductors passing through to feed the turnstile lobe 46 on the terrace 36, at connection 47. At this point, reference to FIGS. 2 and 3 will clarify the nature of this connection. The coaxial individual cable 16(*a*) is one of the four depicted at 16 in FIG. 1 passing through the primary ground plane 10. As assembled, these relationships are depicted sectionally in FIG. 3 as hereinbefore described.

The coaxial cable groups 17, 18 and 19 correspond in the same way to the turnstile sub-assemblies 27, 28 and 29, respectively.

Finally, the innermost group of four quadruple cable feeds comprising 20, 21, 22 and 23 pass through (in addition to the layers aforementioned) the ground plane 37 to which their outer shields are electrically bonded. To take one of these innermost cable groups, for example 19, it might be said that the corresponding turnstile on terrace 40 is 41 and that the type of connection depicted in FIG. 3 is duplicated at that terrace level.

As assembled, the complete antenna assembly resembles FIG. 4. It will be noted that each terrace, i.e., all of the arrays of a given terrace are shrouded with the lossy dielectric material scaled to minimize the effects of multipath reflection on the ascended order array elements. Nevertheless, the effect on overall antenna efficiency resulting from employment of this lossy material is minimal. The loading thereby provided tends to broadband the entire device, as aforementioned, and thus each of the turnstile assemblies intercepts received energy essentially as a non-resonant device much smaller in size than would otherwise be required. Actually, the turnstile lobe or turnstile element size as a function of frequency is governed more by the amount of energy intercepted in each case rather than by resonant element considerations or fractional wavelength criteria.

In addition to the broadbanding effect of the lossy material loading, sensitivity to vertically polarized components at angles other than normal to the surface (that is removed from boresight substantially in angle) is increased.

Typical lossy materials include ferrite and carbonized polyurethene foam. The former affects both electric and magnetic fields and therefore is probably a more efficient lossy material, however, it is substantially heavier than the carbonized polyurethene, that latter material having been successively used for the purpose. It is reemphazied, that the lossy material thickness between a given ground plane and its corresponding terrace of turnstiles must be less than one-half wavelength, since at $\lambda/2$ there is a cancellation effect along boresight. In general, that spacing is best held to a value not exceeding $\frac{3}{8}\lambda$ at the highest frequency of operation expected of each terrace. Obviously, this particular spacing is different in respect to each terrace and its corresponding ground plane, however, the particular thickness of lossy material dictated by that limitation need not apply where the lossy material is strictly an incident wave shroud, i.e., outside the diameter of the ground plane at the particular terrace location. The actual amount of absorbing material provided as a shroud is a non-critical design matter, and relates to the specific characteristics of the material used. A suitable carbonized polyurethane material is known by the trade name Eccosorb LS, (manufactured by Emerson and Cummings, Inc., Canton, Massachusetts). Eccosorb LS is available with dielectric constants ranging from less than 2 to at least 10, with dissipation factors on the order of 0.5 to 1.2, insertion loss characteristics from 5 to 15 decimals and reflectively loss ranging up to 15 dB.

A typical embodiment of the present invention as hereinbefore described covered a total bandwidth (all three terraces) from about 300 MHz to 10GHz in a device so relatively small that the largest individual turnstile lobes did not exceed two inches in length.

Of course, it is not necessary that the three bandwidths of response be contiguous, it being possible to construct the device for three discrete non-contiguous bands of response.

The angles of reception of which the device is capable include substantially all angles within a hemisphere of which the line of boresight is a radius passing through the pole thereof.

Both the terracing of the elements as described and the use of the lossy material as described are important in reducing coupling between terraces.

The entire device is depicted as composed of a concentric buildup of planar tests as in ground planes, however, a certain amount of deviation from this configuration is readily possible without serious interference with the characteristics of the device, for example, the primary ground plane 10 might be somewhat curved to form a somewhat convex surface in at least one dimension as viewed externally along the line of boresight. Thus, it is possible to employ the device mechanically efficiently on the contoured surface of an aircraft or space vehicle, additional protective covering in the form of a radome being applied as required (not illustrated).

On FIG. 1, a beam-forming network 11 is depicted. This beam-forming network is a generalization, its actual configuration relating to the particular application to which the device of the invention is to be applied.

Included in the feed and beam forming circuitry within 11 may be a miniaturized printed circuit balun, an expedient useful in utilizing the relatively small elements at lower frequencies than those at which resonant dipole elements could be efficiently employed. Furthermore, a hybrid network can be included in 11 to provide circular or linear polarization by arranging and controlling the contributions of the mutually orthogonal dipoles of the turnstiles. Still further, each turnstile can be related with an opposite number across the terrace to provide sum and difference modes for direction finding and homing purposes. In that mode, two mutually orthogonal coordinates of angular direction finding or homing can be provided with the turnstiles essentially employed in orthogonally oriented pairs by the beam forming network.

The elements commonly used for beam forming networks for these purposes comprize TEM quadrature couplers, phase shifters and power dividers, all of which may be implemented by those of skill in this art essentially in microcircuitry where powers of a level encountered in energy reception are extant.

Quite obviously the entire device of the invention is fully reciprocal, and can, if desired, be arranged for transmitting as well as receiving, whereby the described device may be applied as a transponder antenna or the like.

Basically, it will be recognized that the actual shape of the turnstile lobes may be varied somewhat from knowledge of antenna theory. The so-called "bow-tie" configuration can be employed, however, the smooth-lobe, turnstile configuration depicted is considered the most desirable element shape.

Other modifications and variations of the structure illustrated and described will suggest themselves to those skilled in this art, accordingly, it is not intended that the drawings in this description should be regarded as limiting the scope of the present invention, these being regarded as typical and illustrative only.

What is claimed is:

1. An antenna system having a high bandwidth and relatively small physical size and being adapted to employment with a variety of interconnecting networks for providing corresponding functions including direction finding and polarization determination, comprising:

a plurality of generally planar antenna subsystems generally arranged symmetrically about a center point in each of a successive plurality of substantially parallel terraces, each of said antenna subsystems in each of said successive terraces being of smaller scale, the boresite of said antenna system being a line passing through said center points of said terraces, said terraces being spaced from each other in a direction parallel to the line of said boresite;

means comprising a feed arrangement to provide external connections to each of said antenna subsystems;

ground plane means for each of said subsystems comprising a conductive plane extending over an area substantially the same as covered by the corresponding one of said antenna subsystems, said ground plane being concentrically placed within and coplanar with the area of the antenna subsystem of the one of said terraces containing the next larger antenna subsystem except for the largest of said antenna subsystems, a separate spaced ground plane being provided for said largest antenna subsystem;

and radio frequency energy absorbing material emplaced at least in the gaps between said antenna subsystems and their corresponding ground planes.

2. Apparatus according to claim 1 in which said absorbing material is defined as being placed on both sides of said terraces, except for the one of said terraces containing the smallest of said antenna subsystems.

3. Apparatus according to claim 1 in which said gaps between each of said planar antenna subsystems and the corresponding ground plane is less then $\lambda/2$ at the highest frequency of operation.

4. Apparatus according to claim 2 in which said gaps between each of said planar antenna subsystems and the corresponding ground plane does not exceed $\frac{3}{8}\lambda$ at the highest frequency of operation for said entire antenna system.

5. Apparatus according to claim 2 in which each of said gaps between said terrace containing one of said planar antenna subsystems and the corresponding ground plane does not exceed $\frac{3}{8}\lambda$ at the highest anticipated frequency of operation for said antenna subsystem.

6. Apparatus according to claim 5 in which said antenna subsystems each comprise a plurality of non-resonant individual center-fed antenna dipole groups arranged in a symmetrical pattern, said groups each comprising a first dipole in a first orientation in the plane of the corresponding terrace and a second dipole physically orthogonal with respect to said first dipole, said groups having electrical and mechanical centers at the feed points, said centers lying equidistant along radii extending in the plane of said corresponding terrace from the intersection of the line of said boresite with said terrace, said radii being uniformly angularly spaced.

7. Apparatus according to claim 6 in which said dipole groups are further defined as turnstile antennas, said groups are four in number and said radii are angularly spaced 90° in the plane of said terrace.

8. Apparatus according to claim 7 in which said turnstile antennas are formed as thin printed-circuit conductive members on a dielectric support layer, said layer with said turnstile elements printed thereon constituting a terrace.

9. Apparatus according to claim 7 in which said dipole groups are each fed by a corresponding group of four coaxial feeds, said feeds having their outer conductors electrically connected to said group plane for the corresponding terrace and the center coaxial conductors are insulatingly fed through said ground plane and the intervening absorbing material to connect, one each, to one of the lobes of one of said dipoles.

10. Apparatus according to claim 7 in which said dipoles are each formed of two conductive material colinear lobes separated by a relatively small distance at said center feed area, said conductive material being further defined as having a conductivity at radio frequencies which is a direct function of frequency, thereby tending to reduce interaction between the antenna elements of said terraces and tending to cause said terraces containing the smaller turnstile of the turnstile elements to be relatively transparent to radio frequency energy of lower frequency passing therethrough toward terraces containing lower frequency responsive elements.

11. Apparatus according to claim 4 in which said absorbent material comprises a carbonized foamed plastic material of a class including polyurethane.

12. Apparatus according to claim 4 in which said absorbent material comprises a ferrite material.

* * * * *